US007207448B1

(12) United States Patent
Marino, Jr.

(10) Patent No.: US 7,207,448 B1
(45) Date of Patent: Apr. 24, 2007

(54) MODULAR STORAGE SYSTEM

(76) Inventor: Frank Marino, Jr., 622 E. Knightsbridge Pl., Lecanto, FL (US) 34461

( * ) Notice: Subject to any disclaimer, the term of this patent is extended or adjusted under 35 U.S.C. 154(b) by 0 days.

(21) Appl. No.: 11/122,606

(22) Filed: May 5, 2005

Related U.S. Application Data

(60) Provisional application No. 60/585,737, filed on Jul. 6, 2004.

(51) Int. Cl.
*A47G 29/00* (2006.01)

(52) U.S. Cl. ..... 211/85.29; 211/126.15; 211/88.02; 211/175; 100/54

(58) Field of Classification Search ..... 211/85.29, 211/29.1, 126.15, 90.02, 151, 88.02, 175; 100/54
See application file for complete search history.

(56) References Cited

U.S. PATENT DOCUMENTS 3,088,424 A * 5/1963 Knuth ..... 108/108
4,487,135 A * 12/1984 Van Ryn ..... 108/25
5,964,359 A * 10/1999 Marino, Jr. ..... 211/74
6,520,350 B1 * 2/2003 Smith ..... 211/87.01

* cited by examiner

*Primary Examiner*—Richard E. Chilcot, Jr.
*Assistant Examiner*—Lindsay M. Maguire
(74) *Attorney, Agent, or Firm*—Gold & Rizvi, P.A.; H. John Rizvi; Glenn E. Gold

(57) ABSTRACT

A modular storage system which is suitable for storing various items such as screws, nuts, bolts, washers and paper clips in a space-efficient and accessible manner is disclosed. The modular storage system includes a storage shelf and multiple containers removably engaging the storage shelf. A tray assembly having multiple trays may be provided in at least one of the containers for storing additional items.

4 Claims, 5 Drawing Sheets

MODULAR STORAGE SYSTEM

CROSS-REFERENCE TO RELATED APPLICATION

This application claims the benefit of co-pending U.S. Provisional Patent Application Ser. No. 60/585,737, filed on Jul. 6, 2004, which is incorporated herein in its entirety.

BACKGROUND OF THE INVENTION

1. Field of the Invention

The present invention relates generally to storage systems used to store various items. More particularly, the present invention relates to a modular storage system which facilitates the organized, space-efficient and readily accessible storage of various items.

2. Description of the Prior Art

Various types of storage systems exist for the storage of various items such as tools, screws, nuts, bolts and other small items which require storage around a house. Frequently, such items are stored together in a drawer. However, this method causes mixing of the items and difficulty in finding the desired item.

Another common manner of storing small items involves the use of jars or cans to contain the items. However, this requires storage space to accommodate the jars or cans. For example, a common practice in the past involved the use of glass jars such as food product jars, the lids of which were nailed to a wooden board or shelf. The parts were placed in the jar, which was then threaded onto the lid. This, however, required proper alignment of the jar for mounting, as well as gripping of the jar while removing the jar from the lid to avoid breakage. If the lid is not tightly secured to the shelf, then turning of the jar could cause turning of the lid such that the jar could not be installed or removed without using the other hand to hold the lid.

A modular storage system is disclosed in U.S. Pat. No. 5,964,359. The modular storage system is adapted for mounting to a support surface such as a wall or the underside of a cabinet. The system includes a base having multiple adjacent lid channels. A specially-designed lid cover removably engages a corresponding one of multiple jars to close each of the jars. With the jars attached to the respective lid covers, each lid cover is slidably inserted in a corresponding lid channel to store the items in the jar. When access to the items in the jar is desired, the lid cover of the jar is slidably removed from the lid channel and then removed from the jar to provide access to the items. The modular storage system in the '359 patent, however, lacks the facility to separately store items which are contained in the same jar.

Accordingly, there is a need for a modular storage system which provides the facility to store items in separate containers in a space-efficient and accessible manner, as well as separately store different items in the same container.

SUMMARY OF THE INVENTION

The invention is directed to a modular storage system which is suitable for storing various items such as screws, nuts, bolts, washers, paper clips and the like in a space-efficient and accessible manner. The modular storage system includes a storage shelf having multiple, adjacent lid channels, each of which is adapted to slidably receive a corresponding container lid that removably fits on a container for containing items. One or more of the containers may contain multiple tiered, compartmented trays each of which is adapted for holding a variety of items.

An object of the present invention is to provide a novel modular storage system which is suitable for the storage of various items such as screws, nuts, bolts, washers, paper clips and the like in a space-efficient and accessible manner.

Another object of the present invention is to provide a novel modular storage system which is suitable to store various items in respective containers which may be arranged in an orderly fashion on a storage shelf to facilitate ease and convenience in the selection and retrieval of an item or items from one or more of the containers.

Still another object of the present invention is to provide a modular storage system which includes multiple containers removably attached to a storage shelf and a multi-tiered tray assembly provided in at least one of the containers to facilitate the simultaneous and compartmental storage of various items in one or more of the containers.

A still further object of the present invention is to provide a modular storage system which includes multiple containers which are removably attached to a support shelf and a container lid fitted with multiple openings removably provided on each container to facilitate closure and ventilation of each container, as needed.

Yet another object of the present invention is to provide a modular storage system including a storage shelf and multiple containers each of which is fitted with a removable container lid that slidably engages a corresponding lid channel provided in the storage shelf to support the containers on the storage shelf in a space-efficient manner and facilitate the storage of selected items in the containers.

A still further object of the present invention is to provide a space-efficient modular storage system which includes a storage shelf having an upper surface adapted for supporting and storing an item or items and multiple containers which removably engage the storage shelf beneath the upper surface to facilitate the storage of various household items in the containers.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the Figures, the present invention is generally directed to a modular storage system which is capable of storing various items in a space-efficient and easily-accessible manner. The modular storage system facilitates the storage of different items in respective containers or the compartmented storage of various items in the same container.

Figure 4:
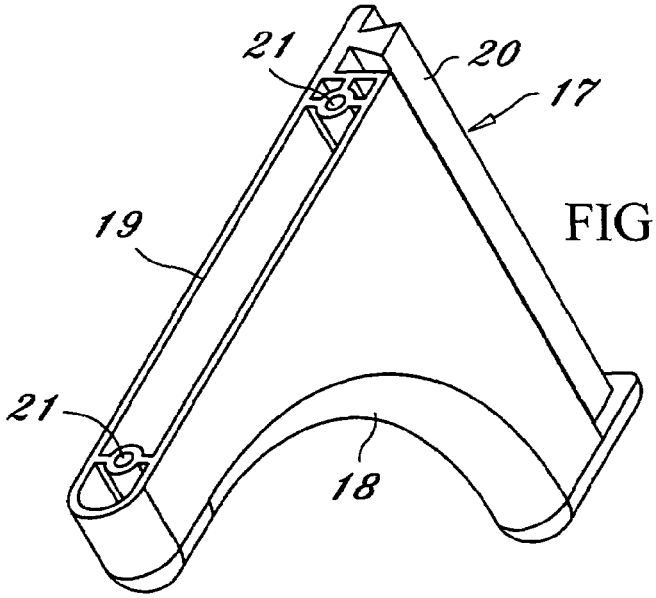
FIG. 4 is a perspective view of a shelf support member for mounting the storage shelf element of the modular storage system to a wall, which shelf support member is provided with a dovetail flange that engages a companion dovetail groove on the storage shelf.
Figure 5:
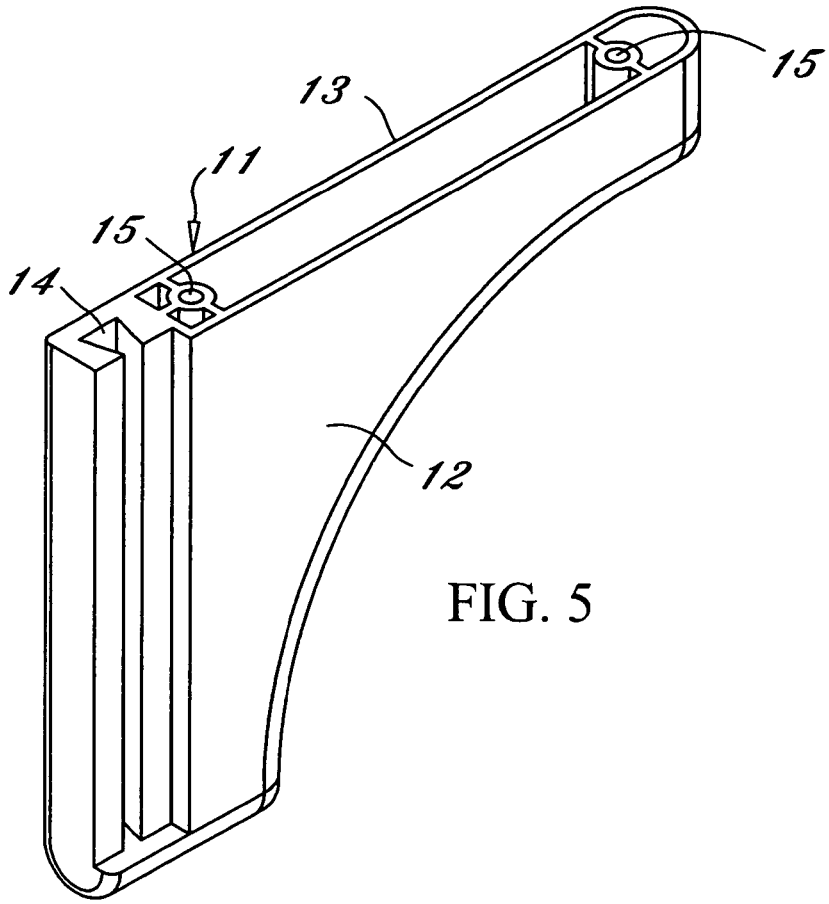
FIG. 5 is a perspective view of another shelf support member for mounting the storage shelf element of the modular storage system to a wall, which shelf support member is provided with a dovetail groove that engages a companion dovetail flange on the storage shelf.
Figure 6:
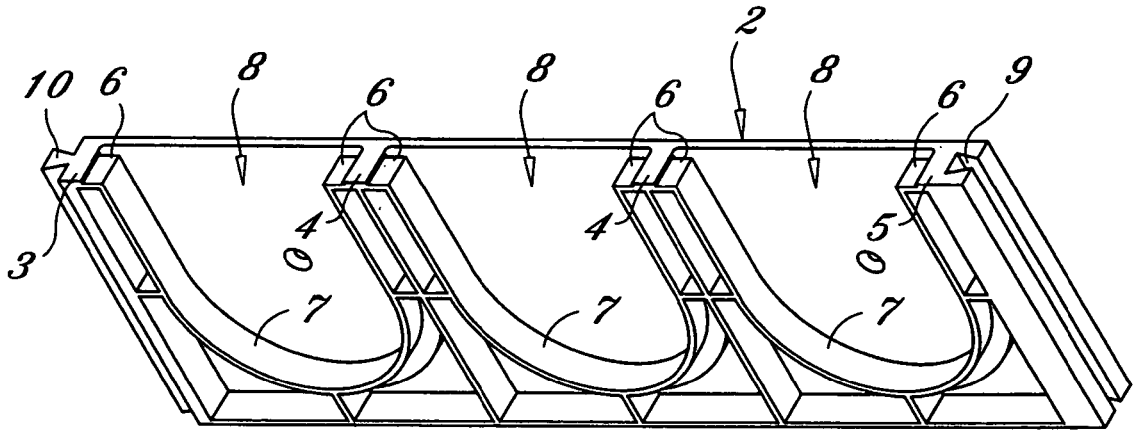
FIG. 6 is a bottom perspective view of the storage shelf element of the modular storage system.

Referring initially to FIGS. 1–6, a preferred embodiment of the modular storage system of the present invention is generally indicated by reference numeral 1. The modular storage system 1 includes a storage shelf 2 having an elongated base member 16 which typically includes an upper surface 2*a* that is suitable for supporting various items, as will be hereinafter described. Outer partitions 3 and 5, respectively, extend downwardly from the bottom surface of the base member 16, at respective ends thereof. Inner partitions 4 extend downwardly from the bottom surface of the base member 16, between the outer partitions 3, 5. As illustrated in FIG. 6, multiple lid support members 7, each of which typically has a generally arcuate shape, extends downwardly from the bottom surface of the storage shelf 2, between the outer partition 3 and the adjacent inner partition 4, between the inner partitions 4, and between the outer partition 5 and the adjacent inner partition 4. Each lid support member 7 defines a lid channel 8. A lid slot 6 is defined between each arcuate lid support member 7 and the bottom surface of the base member 16.

Figure 1:
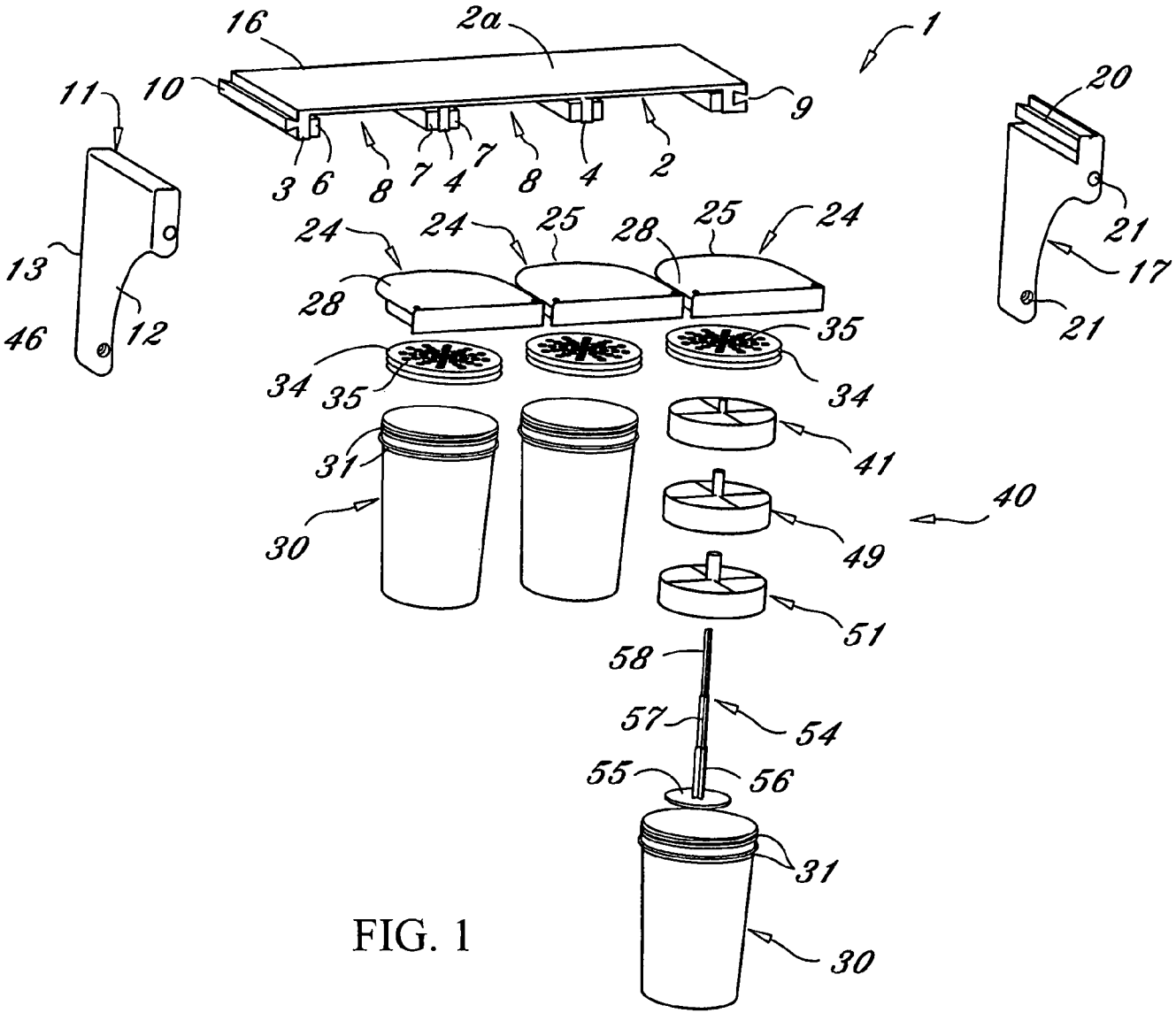
FIG. 1 is an exploded perspective view of a modular storage system according to a preferred embodiment of the invention.

An elongated dovetail flange 10 extends from the lateral surface of the outer partition 3. As illustrated in FIG. 5, a shelf support member 11 includes a body 12 having an attachment portion 13. A pair of spaced-apart mount bolt openings 15 extends through the body 12 and receives mount bolts (not illustrated) to facilitate mounting the attachment portion 13 against a wall (not illustrated). An elongated dovetail groove 14 is provided along an inner surface of the body 12. As illustrated in FIG. 1, the storage shelf 2 is attached to the shelf support member 11 by slidable insertion of the dovetail flange 10 on the storage shelf 2 in the companion dovetail groove 14 (FIG. 5) of the shelf support member 11.

An elongated dovetail groove 9 is provided in the lateral surface of the outer partition 5 of the storage shelf 2. As illustrated in FIG. 4, a shelf support member 17 includes a body 18 having an attachment portion 19. A pair of mount bolt openings 21 extends through the body 18 and receives mount bolts (not illustrated) to facilitate mounting the attachment portion 19 against a wall (not illustrated). An elongated dovetail flange 20 is provided along an inner surface of the body 18. As illustrated in FIG. 1, the storage shelf 2 is attached to the shelf support member 17 by causing the dovetail groove 9 of the storage shelf 2 to slidably receive the companion dovetail flange 20 of the shelf support member 17.

As further illustrated in FIG. 1, the modular storage system 1 further includes multiple containers 30, each of which may be metal, glass or plastic, for example. Exterior container threads 31 extend from the outer surface of each container 30, adjacent to the upper end thereof. In use of the modular storage system 1 as will be hereinafter described, each container 30 is suitable for storing various items such as screws, nuts, bolts, washers, tacks or nails, for example. A container insert 34, typically having multiple openings 35 extending therethrough, may be removably fitted in each container 30 to facilitate pouring particulate contents from the container 30 through the openings 35 as desired, for example.

Figure 2:
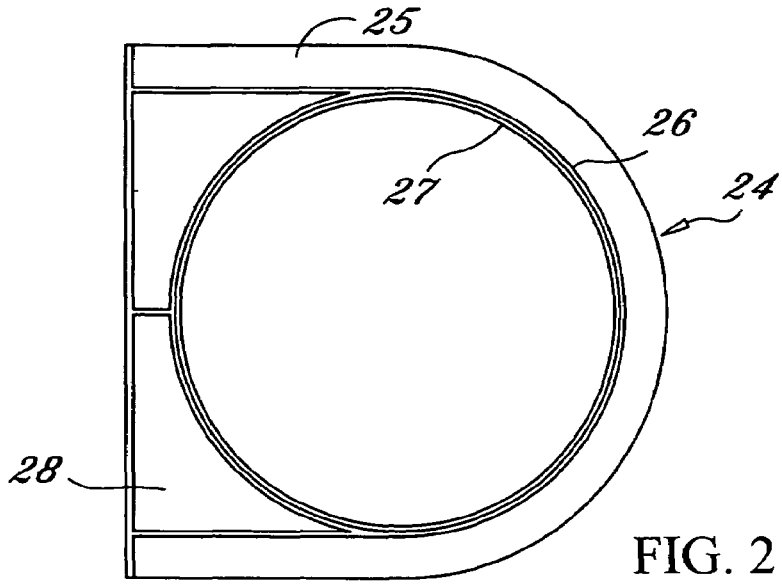
FIG. 2 is a bottom view of a container lid element of the present invention.
Figure 3:
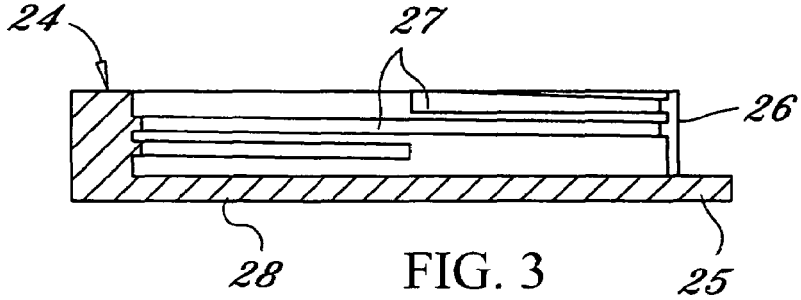
FIG. 3 is a longitudinal sectional view of a container lid element of the present invention, taken along section lines 3—3 in FIG. 2.

Each container 30 can be removably attached to a corresponding container lid 24. Each container lid 24 typically includes a flat lid panel 28. As illustrated in FIGS. 2 and 3, a circular lid wall 26 extends from the bottom surface of the lid panel 28. Multiple lid threads 27 are provided on the interior surface of the lid wall 26. The front portion of the lid panel 28 which extends beyond the lid wall 26 defines an arcuate lid flange 25. Accordingly, a container 30 is removably attached to each container lid 24 by causing engagement of the exterior container threads 31 on the container 30 with the interior lid threads 27 on the lid wall 26. Additionally, each container lid 24 can be removably attached to the storage shelf 2 by inserting the arcuate lid flange 25 of the container lid 24 in the arcuate lid slot 6 of the corresponding lid channel 8, as indicated by the dashed lines in FIG. 1 and will be hereinafter further described.

Figure 7:
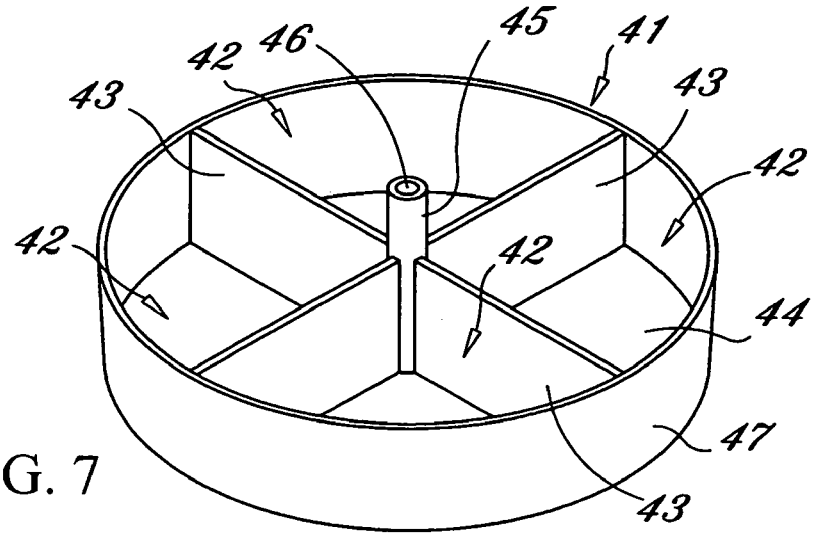
FIG. 7 is a perspective view of an upper tray element of the modular storage system.

Referring next to FIGS. 1 and 7–10, a tray assembly 40 may be provided inside one or each of the containers 30. Each tray assembly 40 typically includes an upper tray 41, a middle tray 49 and a lower tray 51. As illustrated in FIG. 7, the upper tray 41 includes a tray bottom 44, which is typically circular. An annular tray wall 47 extends upwardly from the tray bottom 44, and a partition connector 45 having a stand opening 46 extends upwardly from substantially the center of the tray bottom 44. Multiple partitions 43 which extend upwardly from the tray bottom 44 and span the tray wall 47 and the partition connector 45 define multiple tray compartments 42, each of which is adapted to hold various items such as screws, bolts, nuts, washers, nails and the like (not illustrated).

Figure 8:
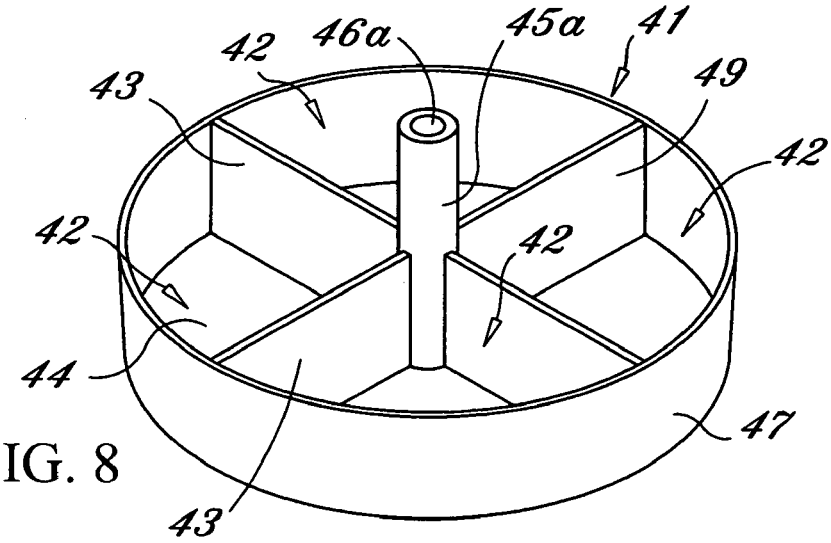
FIG. 8 is a perspective view of a middle tray element of the modular storage system.
Figure 9:
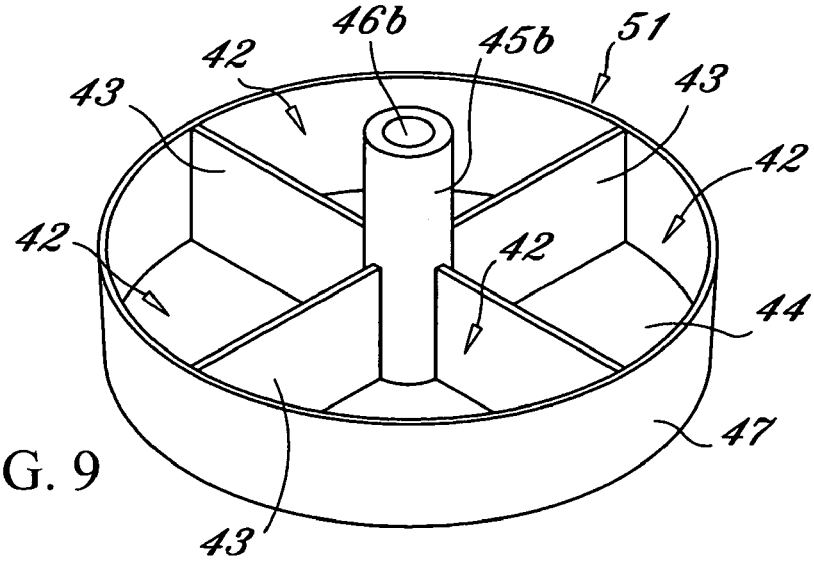
FIG. 9 is a perspective view of a lower tray element of the modular storage system.

As illustrated in FIG. 8, the middle tray 49 is similar in design to the upper tray 41, except the partition connector 45*a* of the middle tray 49 has a stand opening 46*a* the diameter of which is typically larger than that of the stand opening 46 of the upper tray 41. Likewise, as illustrated in FIG. 9, the lower tray 51 has a stand opening 46*b* the diameter of which is typically larger than that of the stand opening 46*a* of the middle tray 49.

Figure 10:
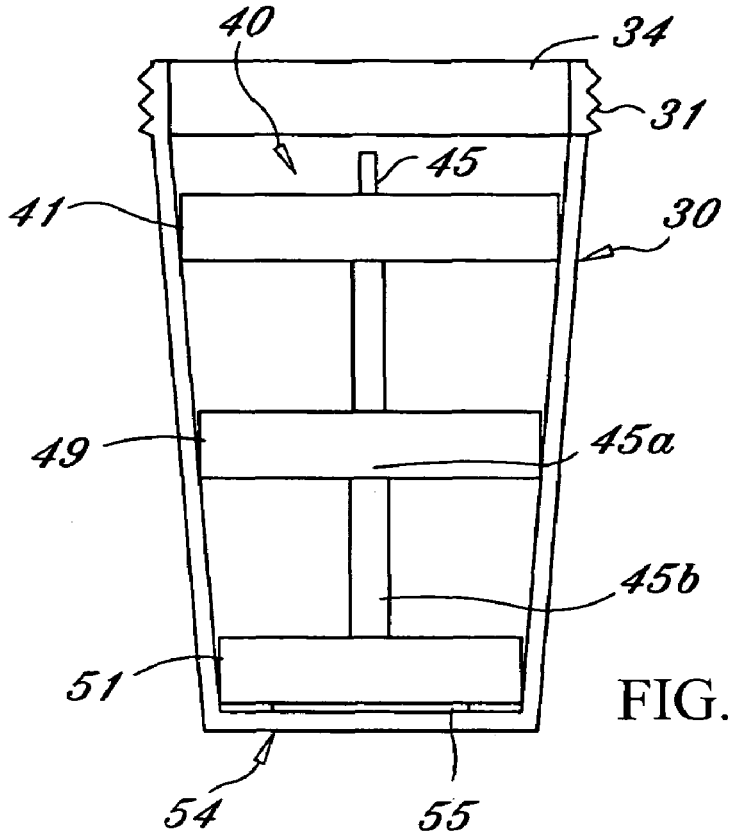
FIG. 10 is a longitudinal cross-sectional view of a container of the modular storage assembly, illustrating a tray assembly provided inside the container.

As illustrated in FIGS. 1 and 10, the tray assembly 40 further includes a tray stand 54. The tray stand 54 includes a flat base 55 which rests on and may be attached to the bottom of the container 30. A bottom stand segment 56 extends upwardly from the base 55, a middle stand segment 57 extends upwardly from the bottom stand segment 56, and an upper stand segment 58 extends upwardly from the middle stand segment 57. The lower stand segment 56 is typically larger in diameter than the middle stand segment 57, and the middle stand segment 57 is typically larger in diameter than the upper stand segment 58. Accordingly, in use of the modular storage system 1, various items (not illustrated) can be placed in the respective tray compartments 42 of the upper tray 41, the middle tray 49 and the lower tray 51 for storage of the items. The lower tray 51 is then placed on the tray stand 54 by extending the bottom stand segment 56 through the stand opening 46*b* (FIG. 9) of the lower tray 51 and resting the lower tray 51 on the base 55 of the tray stand 54, as illustrated in FIG. 10. The middle tray 49 is then stacked on the lower tray 51 by extending the middle stand segment 57 through the stand opening 46*a* (FIG. 8) of the middle tray 49 and resting the middle tray 49 on the lower tray 51. The upper tray 41 is then stacked on the middle tray 49 by extending the upper stand segment 58 through the stand opening 46 (FIG. 7) and resting the upper tray 41 on the middle tray 49.

Figure 11:
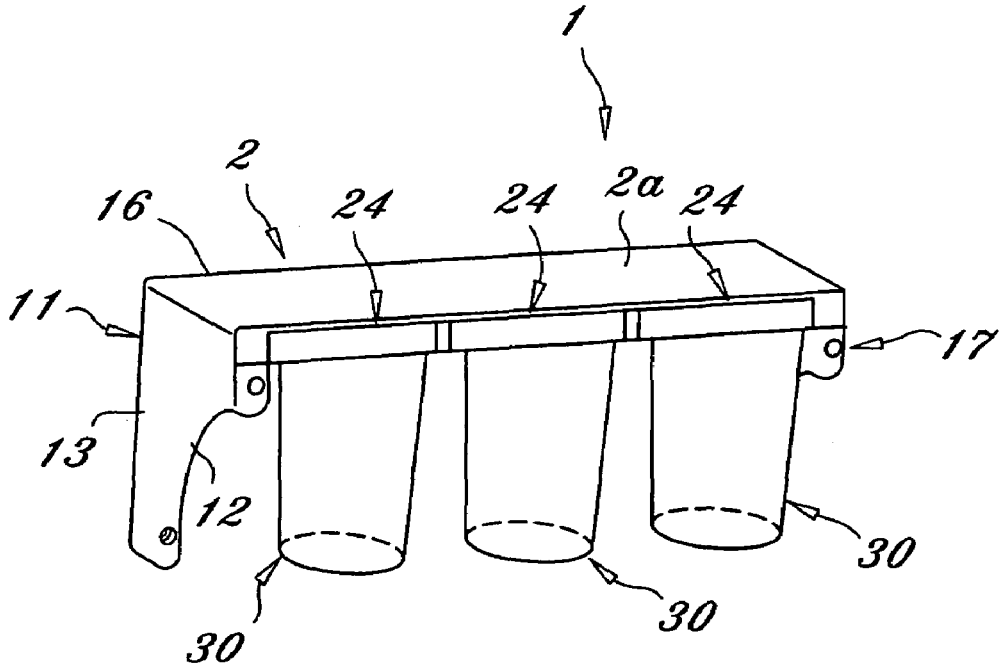
FIG. 11 is a perspective view of the modular storage assembly, with multiple containers removably attached to the storage shelf in an item-storage configuration.

Referring next to FIGS. 1, 10 and 11, in use of the modular storage system 1, various items such as screws, nuts, bolts, washers, nails, tacks and other household items (not illustrated), for example, can be placed separately in the containers 30. In the case of those containers 30 which contain a tray assembly 40, various items can be placed in the respective tray compartments 42 of the upper tray 41, the middle tray 49 and the lower tray 51 and the trays placed on the tray stand 54 inside the container 30, as heretofore described with respect to FIGS. 1 and 10. A container insert 34 can further be placed in each container 30. Each container 30 is next attached to a corresponding container lid 34 by causing threadible engagement of the exterior container threads 31 of the container 30 with the companion interior lid threads 27 (FIG. 2) of the container lid 24. Each container lid 24 is, in turn, removably attached to the storage shelf 2 by slidably inserting the lid flange 25 of the container lid 24 into the lid slot 6 of the corresponding lid channel 8. Therefore, as illustrated in FIG. 1, the containers 30 are suspended downwardly from the storage shelf 2. Various items (not shown) can be placed on the upper surface 2*a* of the storage shelf 2 without interference by the containers 30.

When it is desired to access the items in one of the containers 30, the container lid 24 of the container 30 is removed from the storage shelf 2 by removing the lid flange 25 of the container lid 24 from the lid slot 6 of the corresponding lid channel 8. The container lid 24 is then removed from the container 30 by unthreading the interior lid threads 27 (FIG. 2) of the container lid 24 from the exterior container threads 31 of the container 30. The container 30 is replaced on the support shelf 2 by replacing the container lid 24 on the container 30 and sliding the lid flange 25 of the container lid 24 back into the lid slot 6 of the storage shelf 2.

Items (not shown) contained in the tray compartments 42 of the tray assembly 40 are accessed by removing the container lid 24 from the lid slot 6, removing the container lid 24 from the container 30, removing from the tray stand 54 whichever of the upper tray 41, the middle tray 49 and the lower tray 51 contains the item or items of interest, and accessing the item or items in the tray compartment or compartments 42. The tray assembly 40 is re-assembled by stacking the lower tray 51, middle tray 49 and upper tray 41 on the tray stand 54, replacing the container lid 24 on the container 30, and sliding the lid flange 25 of the container lid 24 in the lid slot 6 of the corresponding lid channel 8 in the storage shelf 2.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A modular storage system comprising:

a storage shelf;

a plurality of containers removably engaging said storage shelf;

a multi-tiered tray assembly provided in at least one of said plurality of containers; and wherein said multi-tiered tray assembly comprises a tray stand having a flat base and at least a first stand segment having a first diameter extending from said flat base and a second stand segment having a second diameter less than said first diameter extending from said first stand segment and at least a first tray provided on said base and receiving said first stand segment and a second tray stacked on said first tray and receiving said second stand segment.

2. The modular storage system of claim 1 wherein said first tray and said second tray each has a plurality of tray compartments.

3. The modular storage system of claim 2 wherein said first tray and said second tray each comprises a tray bottom, a partition connector extending from said tray bottom, a tray wall extending from said tray bottom and surrounding said partition connector, a plurality of partitions extending between said tray wall and said partition connector and a stand opening provided in said partition connector and receiving said tray stand.

4. The modular storage system of claim 3 further comprising a container insert provided in each of said plurality of containers.

* * * * *